US010988925B2

(12) United States Patent
Ju et al.

(10) Patent No.: US 10,988,925 B2
(45) Date of Patent: Apr. 27, 2021

(54) ASSEMBLED LIGHT STEEL STRUCTURE ENERGY-SAVING COMPOSITE WALL

(71) Applicants: Nan Ju, Liaoning (CN); Mingfa Ju, Liaoning (CN)

(72) Inventors: Nan Ju, Liaoning (CN); Mingfa Ju, Liaoning (CN)

( * ) Notice: Subject to any disclaimer, the term of this patent is extended or adjusted under 35 U.S.C. 154(b) by 0 days.

(21) Appl. No.: 16/753,952

(22) PCT Filed: Mar. 13, 2019

(86) PCT No.: PCT/CN2019/077916
§ 371 (c)(1),
(2) Date: Apr. 6, 2020

(87) PCT Pub. No.: WO2020/181513
PCT Pub. Date: Sep. 17, 2020

(65) Prior Publication Data
US 2021/0010265 A1 Jan. 14, 2021

(51) Int. Cl.
*E04B 2/60* (2006.01)
*E04B 2/56* (2006.01)
(Continued)

(52) U.S. Cl.
CPC ..... *E04B 2/60* (2013.01); *E04B 2/562* (2013.01); *E04C 3/07* (2013.01); *E04C 3/32* (2013.01);
(Continued)

(58) Field of Classification Search
CPC ..... E04B 2/60; E04B 2/562; E04B 1/34853; E04F 13/142; E04F 13/0805; E04C 3/07; E04C 3/32; E04C 2003/026
See application file for complete search history.

(56) References Cited

U.S. PATENT DOCUMENTS 1,445,113 A * 2/1923 Tromanhauser ..... E04B 2/562 52/327
2,169,255 A * 8/1939 Kotrbaty ..... E04B 2/7401 52/97
(Continued)

FOREIGN PATENT DOCUMENTS

CN 203626849 U 6/2014
CN 107143055 A 9/2017
(Continued)

*Primary Examiner* — Adriana Figueroa
(74) *Attorney, Agent, or Firm* — Muncy, Geissler, Olds and Lowe, P.C.

(57) ABSTRACT

The assembled light steel structure energy-saving composite wall in the present invention comprises: a cement board and/or ceramic tile, a column, a support rod, a cross beam, a bottom plate, a diagonal brace and a diagonal draw steel bar. In the thickness direction of the composite wall, the horizontal side of each group of columns is outside the composite wall, a plurality of support rods and diagonal braces are installed between the four second vertical sides of the columns of the each opposite group of columns. In the width direction of the composite wall, a plurality of cross beams and diagonal draw steel bars are installed between the first vertical sides of the column of the adjacent groups of columns. On both sides of the thickness direction of the composite wall, the horizontal sides of the column of the two adjacent columns are provided with a cement board and/or a ceramic tile inserted by a strip fastener and a strip, and the space enclosed by the cement board and the ceramic tile, the cement board and the cement board or the ceramic tile and the ceramic tile is filled with the filler. The assembled light steel structure wall system is simple to assemble, convenient to transport, operate and maintain, energy-saving and heat-preserving, the wall installation and wall decoration is completed at one time.

6 Claims, 2 Drawing Sheets

(51) Int. Cl.

| | |
|---|---|
| ***E04C 3/07*** | (2006.01) |
| ***E04C 3/32*** | (2006.01) |
| ***E04F 13/08*** | (2006.01) |
| ***E04F 13/14*** | (2006.01) |
| *E04C 3/02* | (2006.01) |

(52) U.S. Cl.
CPC ..... *E04F 13/0805* (2013.01); *E04F 13/142* (2013.01); *E04C 2003/026* (2013.01)

(56) References Cited

U.S. PATENT DOCUMENTS 4,641,468 A * 2/1987 Slater ..... E04B 1/12 52/309.4
8,234,833 B2 * 8/2012 Miller ..... E04C 2/22 52/745.05
8,910,439 B2 * 12/2014 Ingjaldsdottir ..... E04B 1/3483 52/309.16
8,978,324 B2 * 3/2015 Collins ..... E04B 2/72 52/220.1
2005/0204697 A1 * 9/2005 Rue ..... E04B 1/14 52/782.1
2006/0117689 A1 * 6/2006 Onken ..... E04C 2/22 52/309.7
2013/0205698 A1 * 8/2013 Todd ..... E04F 13/083 52/302.1
2013/0312352 A1 * 11/2013 Gale ..... E04F 13/24 52/483.1
2013/0326986 A1 * 12/2013 Krivtsov ..... E04B 1/24 52/479

FOREIGN PATENT DOCUMENTS

CN 207846652 U 9/2018
CN 207934250 U 10/2018
DE 19506482 A1 * 9/1996 ..... E04B 2/562
GB 582097 A 11/1946
WO WO-2005061810 A1 * 7/2005 ..... E04B 2/562

* cited by examiner

ASSEMBLED LIGHT STEEL STRUCTURE ENERGY-SAVING COMPOSITE WALL

FIELD OF THE INVENTION

The invention relates to a composite wall, in particular to an assembled light steel structure energy-saving composite wall.

BACKGROUND OF THE INVENTION

With the development of society and the improvement of living standards, people have higher and higher requirements for living environment. Driven by the policies of "green building action" and "building industrialization" and economic development, prefabricated light steel structure building has become a hotspot of research and exploration. Because of its convenient assembly and transportation, the assembled light steel structure wall system has been more and more used in many fields. However, the existing composite wall relies more on the foundation, installation and transportation are inconvenient, so it is needed to be specially processed for special environments, and after the wall is installed, its interior and exterior are needed to be further decorated.

SUMMARY OF THE INVENTION

The purpose of the invention of the present application is to solve the problem of poor universality of the existing composite wall, and to provide an assembled light steel structure energy-saving composite wall, which can be adapted to various wall bodies.

To achieve the above purpose, the present invention adopts the following technical solutions:

an assembled light steel structure energy-saving composite wall of the present invention comprises: a cement board and/or ceramic tile, a column, a support rod, a cross beam, a bottom plate, a diagonal brace and a diagonal draw steel bar, the bottom plate is installed on the bottom surface of the composite wall, in the thickness direction of the composite wall, a group of columns composed of two columns are welded to the bottom plate, a plurality of support rods are installed between the two columns, the support rods are evenly arranged in parallel in the height direction of the column, diagonal braces are installed between the two adjacent support rods and between the support rod and the bottom plate; in the width direction of the composite wall, several groups of columns are welded to the bottom plate, and several cross beams and diagonal draw steel bars are installed between the adjacent columns in the width direction, the cross beams are evenly arranged in parallel in the height direction of the columns, the diagonal draw steel bars are installed between two adjacent cross beams and between the cross beam and the bottom plate, in which the column is a column bent by a steel plate with the cross-section composed of a horizontal side of the column, a first vertical side of the column, an inclined side of the column and a second vertical side of the column, the two ends of the horizontal side of the column are respectively connected with the first vertical side of the column, the two second vertical sides of the columns are respectively connected with the first vertical sides of the two columns through the inclined sides of the two columns, the first vertical side of the column and the second vertical side of the column are parallel to each other and are perpendicular to the horizontal side of the column, the vertical distance between the two second vertical sides of the columns is less than the width of the horizontal side of the column, along the height of the column, there are two rows of bolt holes in the horizontal side of the column, with one row of bolt holes in the first vertical side and another row in the second vertical side of the column; in the thickness direction of the composite wall, the horizontal side of each group of columns is outside the composite wall, a plurality of support rods and diagonal braces are installed between the four second vertical sides of the columns of the each opposite group of columns, and the two ends of the support rods and diagonal braces are respectively fixed between the two second vertical sides of the columns by bolts, nuts and washers; in the width direction of the composite wall, a plurality of cross beams and diagonal draw steel bars are installed between the first vertical sides of the column of the adjacent groups of columns, lifting lugs are welded to the two ends of the cross beam, bolt holes are provided in the lifting lug, the cross beam is fixed to the first vertical side of the column of the two adjacent columns through lifting lugs, bolts, nuts and washers, a screw is threaded on the two ends of the diagonal draw steel bar, the two ends of the diagonal draw steel bar pass through the bolt holes in the first vertical side of the column of the two adjacent columns respectively, and are fixed to the first vertical side of the column of the two adjacent columns respectively by nuts and washers; on both sides of the thickness direction of the composite wall, the horizontal sides of the column of the two adjacent columns are provided with a cement board and/or a ceramic tile inserted by a strip fastener and a strip, the cement board is fixed to the horizontal side of the column of the two adjacent columns by bolts, nuts and washers, the strip fastener is fixed to the horizontal sides of the column of the two adjacent columns, the strip is inserted in strip fastener, the ceramic tile is inserted in the strip, and the space enclosed by the cement board and the ceramic tile, the cement board and the cement board or the ceramic tile and the ceramic tile is filled with the filler.

The assembled light steel structure energy-saving composite wall of the invention, wherein, the strip fastener is a sheet whose cross section includes a vertical side of the strip fastener and a hook of the strip fastener, the two ends of the vertical side of the strip fastener are respectively provided with a hook of the strip fastener, the hook of the strip fastener is symmetrically arranged with respect to the center line of the vertical side of the strip fastener, a bolt hole is provided in the vertical side of the strip fastener, the strip fastener is fixed to the horizontal side of the column by bolts, nuts and washers, and the strip is inserted in the space enclosed by the vertical side of the strip fastener and the hooks of the two strip fasteners.

The assembled light steel structure energy-saving composite wall of the invention, wherein, the strip fastener is a strip whose cross section includes a vertical side of the strip, the horizontal side of the strip and the buckle side of the strip, the horizontal side of the strip is in the center of the vertical side of the strip and perpendicular to the vertical side of the strip, the buckle side of the strip is arranged on one side or both sides of one end of the horizontal side of the strip, the buckle side of the strip is perpendicular to the horizontal side of the strip, and the end thereof is inclined towards the vertical side of the strip, the vertical side of the strip is inserted in the space enclosed by the vertical side of the strip fastener and the two hooks of the strip fasteners, and the ceramic tile is inserted between the buckle sides of the two adjacent strips or between the buckle side of the strip and the base plate.

The assembled light steel structure energy-saving composite wall of the invention, wherein the filler is one or a combination of construction waste, slag, foamed material and stainless steel air box.

The assembled light steel structure energy-saving composite wall of the invention, wherein the stainless steel air box is an empty box made of stainless steel plate, and the stainless steel air box is fixed to the first vertical side of the column and/or the cross beam by positioning pieces, screws and nuts.

The assembled light steel structure energy-saving composite wall of the invention, wherein, the composite wall also includes a connector which is a cylinder having the same cross section as that of the column. In the height direction of the composite wall, the connector is inserted in two adjacent columns in the height direction, fixing the connector with the first vertical side of the column of and the second vertical side of the column of the two adjacent columns by screws, nuts and washers together.

Compared with the prior art, the assembled light steel structure energy-saving composite wall of the present invention has the advantages that the assembled light steel structure wall system is simple to assemble, convenient to transport, operate and maintain, energy-saving and heat-preserving, the wall installation and wall decoration is completed at one time, not only reducing the transportation cost and processing cost, but also reducing the gradually rising labor cost. It can be adapted to various walls and be more and more used in many fields.

Figure 1:
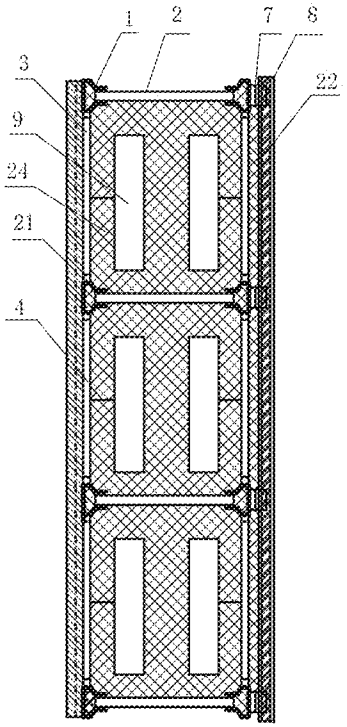
FIG. 1 is a vertical schematic view of the assembled light steel structure energy-saving composite wall of the present invention.

For the sake of clarity, bolts, screws, washers and nuts are omitted in FIGS. 1 to 7.

In FIGS. 1 to 7, reference number 1 is the column; reference number 2 is the support rod; reference number 3 is the cross beam; reference number 4 is the positioning piece; reference number 5 is the base plate; reference number 6 is the diagonal brace; reference number 7 is the strip fastener; reference number 8 is the strip; reference number 9 is the stainless steel air box; reference number 10 is the diagonal draw steel bar; reference number 11 is the horizontal side of the column; reference number 12 is the first vertical side of the column; reference number 13 is the inclined side of the column; reference number 14 is the second vertical side of the column; reference number 15 is the vertical side of the strip fastener; reference number 16 is the hook of the strip fastener; reference number 17 is the vertical side of the strip; reference number 18 is the horizontal side of the strip; reference number 19 is the buckle side of the strip; reference number 20 is the lifting lug; reference number 21 is the cement plate; reference number 22 is the ceramic tile; reference number 23 is the connector; and reference number 24 is the filler.

DESCRIPTION OF THE EMBODIMENTS

Figure 2:
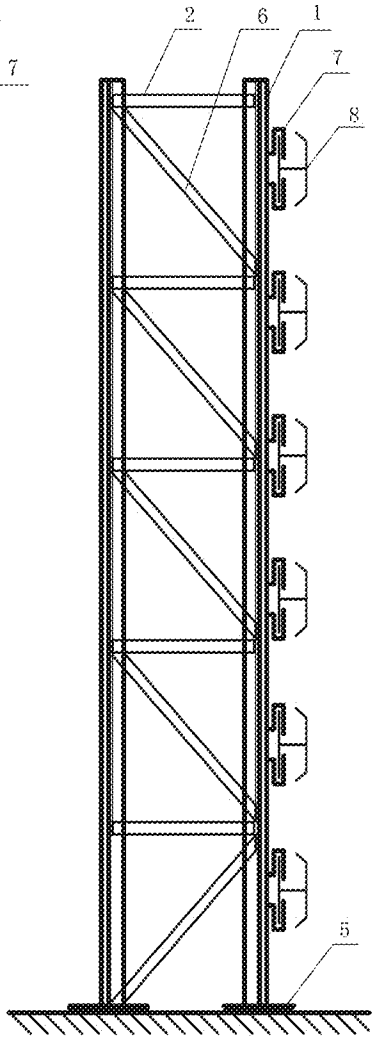
FIG. 2 is the side schematic view of the assembled light steel structure energy-saving composite wall of the present invention, for the sake of clarity, the cement board and the ceramic tile are removed from the view.
Figure 3:
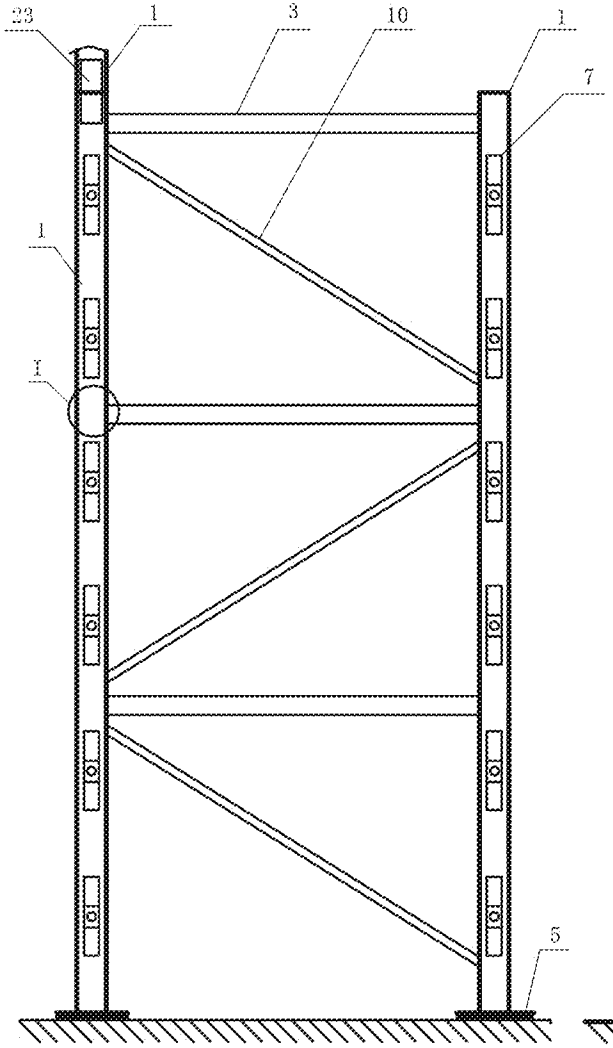
FIG. 3 is a front schematic view of the assembled light steel structure energy-saving composite wall of the present invention, for the sake of clarity, the strip and the ceramic tile are removed from the view.

As shown in FIGS. 1 to 3, an assembled light steel structure energy-saving composite wall of the present invention comprises a cement board 21 and/or ceramic tile 22, a column 1, a support rod 2, a cross beam 3, a bottom plate 5, a diagonal brace 6, a diagonal draw steel bar 10 and a connector 23, the bottom plate 5 is installed on the bottom surface of the composite wall, in the thickness direction of the composite wall, a group of columns 1 composed of two columns 1 are welded to the bottom plate 5, a plurality of support rods 2 are installed between the two columns 1, the support rods 2 are evenly arranged in parallel in the height direction of the column 1, diagonal braces 6 are installed between the two adjacent support rods 2 and between the support rod 2 and the bottom plate 5; in the width direction of the composite wall, several groups of columns 1 are welded to the bottom plate 5, and several cross beams 3 and diagonal draw steel bars 10 are installed between the adjacent columns 1 in the width direction, the cross beams 3 are evenly arranged in parallel in the height direction of the columns 1, the diagonal draw steel bars 10 are provided between two adjacent cross beams 3 and between the cross beam 3 and the bottom plate 5.

Figure 4:
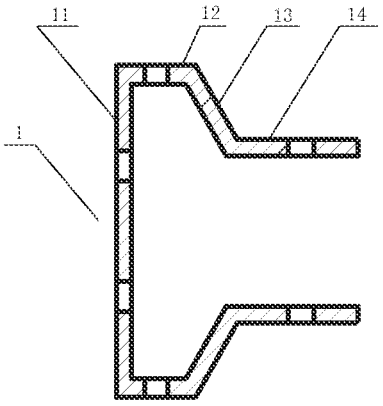
FIG. 4 is a vertical schematic view of the enlarged section of the column.

As shown in FIG. 4, the column 1 is a column bent by a steel plate with the cross-section composed of a horizontal side 11 of the column, a first vertical side 12 of the column, an inclined side 13 of the column and a second vertical side 14 of the column, the two ends of the horizontal side 11 of the column are respectively connected with the first vertical side 12 of the column, the two second vertical sides 14 of the columns are respectively connected with the first vertical sides 12 of the two columns through the inclined sides 13 of the two columns, the first vertical side 12 of the column and the second vertical side 14 of the column are parallel to each other and are perpendicular to the horizontal side 11 of the column, the vertical distance between the two second vertical sides 14 of the columns is less than the width of the horizontal side 11 of the column, along the height of the column 1, there are two rows of bolt holes in the horizontal side 11 of the column, with one row of bolt holes in the first vertical side 12 and another row in the second vertical side 14 of the column.

In the thickness direction of the composite wall, the horizontal side 11 of each group of columns 1 is outside the composite wall, a plurality of support rods 2 and diagonal braces 6 are installed between the four second vertical sides 14 of the columns of the each opposite group of columns 1, and the two ends of the support rods 2 and diagonal braces 6 are respectively fixed between the second vertical sides 14 of the two columns 1 by bolts, nuts and washers.

Figure 5:
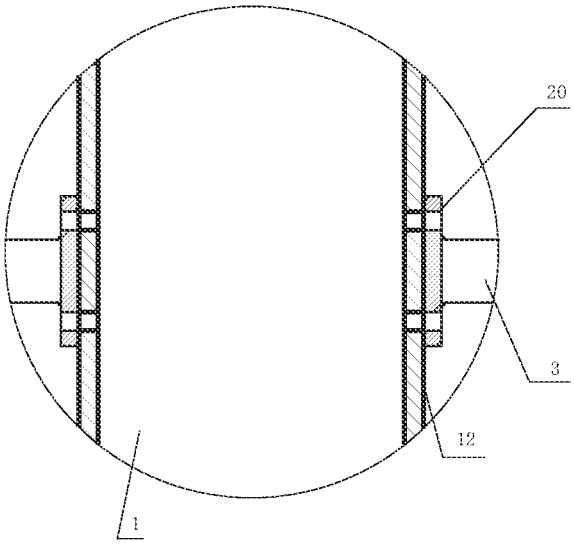
FIG. 5 is an enlarged schematic view at I of FIG. 3, in which the relationship among the column, the cross beam and the lifting lug is clearly shown.

As shown in FIG. 5, in the width direction of the composite wall, a plurality of cross beams 3 and diagonal draw steel bars 10 are installed between the first vertical sides 12 of the column of the adjacent groups of columns 1, lifting lugs 20 are welded to the two ends of the cross beam 3, bolt holes are provided in the lifting lug 20, the cross beam 3 is fixed to the first vertical side 12 of the column of the two adjacent columns 1 through lifting lugs 20, bolts, nuts and washers, a screw is threaded on the two ends of the diagonal draw steel bar 10, the two ends of the diagonal draw steel bar 10 pass through the bolt holes in the first vertical side 12 of the column of the two adjacent columns 1 respectively, and are fixed to the first vertical side 12 of the column of the two adjacent columns 1 respectively by nuts and washers. As shown in FIG. 3, the diagonal draw steel bars 10 are installed between two adjacent cross beams 3 or between the cross beam 3 and the bottom plate 5.

As shown in FIG. 1, on both sides of the thickness direction of the composite wall, the horizontal sides 11 of the column of the two adjacent columns 1 are provided with a cement board 21 and/or a ceramic tile 22 inserted by a strip fastener 7 and a strip 8, the strip fastener 7 is fixed to the horizontal sides 11 of the column of the two adjacent columns 1, the strip 8 is inserted in strip fastener 7, the ceramic tile 22 is inserted in the strip 8, and the space enclosed by the cement board 21 and the ceramic tile 22, the cement board 21 and the cement board 21 or the ceramic tile 22 and the ceramic tile 22 is filled with the filler 24. The filler 24 is one or a combination of construction waste, slag, foamed material and stainless steel air box 9. The stainless steel air box 9 is an empty box made of stainless steel plate, and the stainless steel air box is fixed to the first vertical side 12 of the column 1 and/or the cross beam 3 by positioning pieces 4, screws and nuts.

As shown in FIG. 3, the connector 23 is a cylinder having the same cross section as that of the column 1. In the height direction of the composite wall, the connector 23 is inserted into the two adjacent columns 1 in the height direction, fixing the connector 23 with the first vertical side 12 of the column of and the second vertical side 14 of the column of the two adjacent columns 1 by screws, nuts and washers together.

Figure 6:
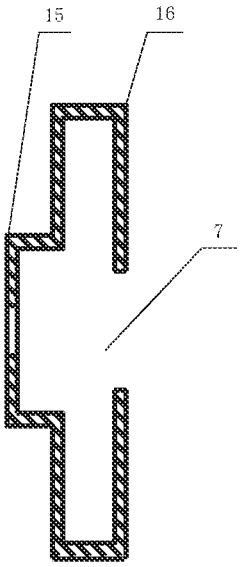
FIG. 6 is a vertical schematic view of the enlarged section of the strip fastener.

As shown in FIG. 6, the strip fastener 7 is a sheet whose cross section includes a vertical side 15 of the strip fastener and a hook 16 of the strip fastener, the two ends of the vertical side 15 of the strip fastener are respectively provided with a hook 16 of the strip fastener, the hook 16 of the strip fastener is symmetrically arranged with respect to the center line of the vertical side 15 of the strip fastener, a bolt hole is provided in the vertical side 15 of the strip fastener, the strip fastener 7 is fixed to the horizontal side 11 of the column by bolts, nuts and washers, and the strip 8 is inserted in the space enclosed by the vertical side 15 of the strip fastener and the two hooks 16 of the strip fasteners.

Figure 7:
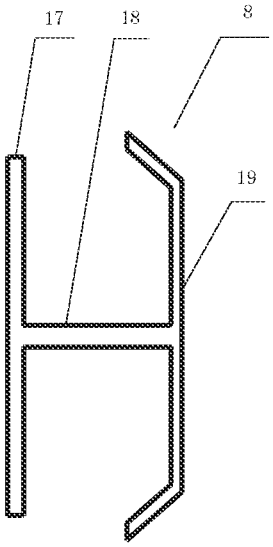
FIG. 7 is a vertical enlarged schematic view of the strip.

As shown in FIG. 7, the strip 8 is a strip whose cross section includes a vertical side 17 of the strip, the horizontal side 18 of the strip and the buckle side 19 of the strip, the horizontal side 18 of the strip is in the center of the vertical side 17 of the strip and perpendicular to the vertical side 17 of the strip, the buckle side 19 of the strip is arranged on one side or both sides of one end of the horizontal side 18 of the strip, the buckle side 19 of the strip is perpendicular to the horizontal side 18 of the strip, and the end thereof is inclined towards the vertical side 17 of the strip, the vertical side 17 of the strip is inserted in the space enclosed by the vertical side 15 of the strip fastener and the two hooks 16 of the strip fasteners, and the ceramic tile 22 is inserted between the buckle sides 19 of the two adjacent strips 8 or between the buckle side 19 of the strip and the base plate 5.

During construction, a group of columns 1 composed of two columns 1 is welded to the bottom plate 5 in the thickness direction of the composite wall, a plurality of support rods 2 are installed between the two columns 1, and the diagonal brace 6 is installed between the two adjacent support rods 2. In the width direction of the composite wall, several groups of columns 1 are welded to the bottom plate 5, a plurality of cross beams 3 and diagonal draw steel bars 10 are installed between adjacent columns 1, and the diagonal draw steel bar 10 is provided between the two adjacent cross beams 3. On both sides of the thickness direction of the composite wall, the horizontal sides 11 of the column of the two adjacent columns 1 are provided with a cement board 21 and/or a ceramic tile 22 inserted by a strip fastener 7 and a strip 8, and the space enclosed by the cement board 21 and the ceramic tile 22, the cement board 21 and the cement board 21 or the ceramic tile 22 and the ceramic tile 22 is filled with the filler 24. If the height of the wall is not enough, the height of the wall can also be increased by installing the connector 23 on the column 1.

INDUSTRIAL APPLICABILITY

The assembled light steel structure energy-saving composite wall of the present invention can be widely used in the construction industry.

The above description is an explanation of the present invention, not a limitation of the invention. The scope of the present invention can refer to the claims. The present invention can be modified in any form without departing from the spirit of the invention.

The invention claimed is:

1. An assembled light steel structure energy-saving composite wall comprises:

a cement board (21) and/or ceramic tile (22), a column (1), a support rod (2), a cross beam (3), a bottom plate (5), a diagonal brace (6) and a diagonal draw steel bar (10), the bottom plate (5) is installed on the bottom surface of the composite wall, in the thickness direction of the composite wall, a group of the columns (1) composed of two of the columns (1) is welded to the bottom plate (5), a plurality of the support rods (2) are installed between the two columns (1), the support rods (2) are evenly arranged in parallel in the height direction of the columns (1), the diagonal braces (6) are installed between two adjacent said support rods (2) and between the lowest support rod (2) and the bottom plate (5);

in the width direction of the composite wall, several groups of the columns (1) are welded to the bottom plate (5), and several of the cross beams (3) and the diagonal draw steel bars (10) are installed between the adjacent columns (1) in the width direction, the cross beams (3) are evenly arranged in parallel in the height direction of the columns (1), the diagonal draw steel bars (10) are installed between two adjacent said cross beams (3) and between the lowest cross beam (3) and the bottom plate (5), wherein the column (1) is a column bent by a steel plate with a cross-section composed of a horizontal side (11) of the column, two first vertical sides (12) of the column, two inclined sides (13) of the column and two second vertical sides (14) of the column, two ends of the horizontal side (11) of the column are respectively connected with the two first vertical sides (12) of the column, the two second vertical sides (14) of the columns are respectively connected with the two first vertical sides (12) of the columns through the two inclined sides (13) of the columns, the two first vertical sides (12) of the column and the two second vertical sides (14) of the column are parallel to each other and are perpendicular to the horizontal side (11) of the column, the vertical distance between the two second vertical sides (14) of the columns is less than the width of the horizontal side (11) of the column, along the height of the column (1), there are two rows of bolt holes in the horizontal side (11) of the column, with one row of bolt holes in the two first vertical sides (12) and another row in the two second vertical sides (14) of the column;

in the thickness direction of the composite wall, the horizontal side (11) of each group of columns (1) is outside the composite wall, a plurality of the support rods (2) and the diagonal braces (6) are installed between the two second vertical sides (14) of each columns of the group of columns (1), and the two ends of the support rods (2) and the diagonal braces (6) are respectively fixed between the two second vertical sides (14) of the columns by bolts, nuts and washers;

in the width direction of the composite wall, a plurality of the cross beams (3) and the diagonal draw steel bars (10) are installed between the first vertical sides (12) of the column of the adjacent groups of columns (1), lifting lugs (20) are welded to two ends of the cross beam (3), bolt holes are provided in the lifting lug (20), the cross beam (3) is fixed to the first vertical side (12) of the column of the two adjacent columns (1) through lifting lugs, bolts, nuts and washers, a screw is threaded on two ends of the diagonal draw steel bar (10), the two ends of the diagonal draw steel bar (10) pass through the bolt holes in the first vertical side (12) of the column of the two adjacent columns (1) respectively, and are fixed to the first vertical side (12) of the column of the two adjacent columns (1) respectively by nuts and washers;

on both sides of the thickness direction of the composite wall, the horizontal sides (11) of the column of the two adjacent columns (1) are provided with a cement board (21) and/or a ceramic tile (22) secured by a strip fastener (7) and a strip (8), the cement board (21) is fixed to the horizontal side (11) of the column of the two adjacent columns (1) by screws, the strip fastener (7) is fixed to the horizontal sides (11) of the column of the two adjacent columns (1), the strip (8) is inserted in the strip fastener (7), the ceramic tile (22) is inserted in the strip (8), and the space enclosed by the cement board (21) and the ceramic tile (22), the cement board (21) and the cement board (21) or the ceramic tile (22) and the ceramic tile (21) is filled with a filler (24).

2. The assembled light steel structure energy-saving composite wall according to claim 1, wherein the strip fastener (7) is a sheet whose cross section includes a vertical side (15) of the strip fastener and a hook (16) of the strip fastener, two ends of the vertical side (15) of the strip fastener are respectively provided with the hook (16) of the strip fastener, the hook (16) of the strip fastener is symmetrically arranged with respect to the center line of the vertical side (15) of the strip fastener, a bolt hole is provided in the vertical side (15) of the strip fastener, the strip fastener (7) is fixed to the horizontal side (11) of the column by bolts, nuts and washers, and the strip (8) is inserted in the space enclosed by the vertical side (15) of the strip fastener and the two hooks (16) of the strip fasteners.

3. The assembled light steel structure energy-saving composite wall according to claim 2, wherein the strip (8) is a strip whose cross section includes a vertical side (17) of the strip, a horizontal side (18) of the strip and a buckle side (19) of the strip, the horizontal side (18) of the strip is in the center of the vertical side (17) of the strip and perpendicular to the vertical side (17) of the strip, the buckle side (19) of the strip is arranged on one side or both sides of one end of the horizontal side (18) of the strip, the buckle side (19) of the strip is perpendicular to the horizontal side (18) of the strip, and the end thereof is inclined towards the vertical side (17) of the strip, the vertical side (17) of the strip is inserted in the space enclosed by the vertical side (15) of the strip fastener and the two hooks (16) of the strip fasteners, and the ceramic tile (22) is inserted between the buckle sides (19) of the two adjacent strips (8) or between the buckle side (19) of the strip and the base plate (5).

4. The assembled light steel structure energy-saving composite wall according to claim 3, wherein the filler (24) is one or a combination of construction waste, slag, foamed material and stainless steel air box (9).

5. The assembled light steel structure energy-saving composite wall according to claim 4, wherein the stainless steel air box (9) is an empty box made of stainless steel plate, and the stainless steel air box is fixed to the first vertical side (12) of the column (1) and/or the cross beam (3) by positioning pieces (4), screws and nuts.

6. The assembled light steel structure energy-saving composite wall according to claim 5, wherein, the composite wall also includes a connector (23), which is a cylinder having the same cross section as that of the column (1), in the height direction of the composite wall, the connector (23) is inserted into the two adjacent columns (1) in the height direction, fixing the connector (23) with the first vertical side (12) of the column of and the second vertical side (14) of the column of the two adjacent columns (1) by screws, nuts and washers together.

* * * * *